United States Patent [19]

Inagaki et al.

[11] Patent Number: 4,685,428

[45] Date of Patent: Aug. 11, 1987

[54] MULTI-CYLINDER INTERNAL COMBUSTION ENGINE

[75] Inventors: Takashi Inagaki; Toshio Shimada; Tokuji Yoshimoto, all of Saitama, Japan

[73] Assignee: Honda Giken Kogyo Kabushiki Kaisha, Tokyo, Japan

[21] Appl. No.: 712,267

[22] Filed: Mar. 15, 1985

[30] Foreign Application Priority Data

| | | | |
|---|---|---|---|
| Mar. 15, 1984 | [JP] | Japan | 59-50061 |
| Mar. 15, 1984 | [JP] | Japan | 59-50062 |
| Mar. 15, 1984 | [JP] | Japan | 59-50063 |
| Mar. 15, 1984 | [JP] | Japan | 59-50064 |
| Mar. 15, 1984 | [JP] | Japan | 59-50065 |
| Mar. 15, 1984 | [JP] | Japan | 59-50066 |
| Mar. 15, 1984 | [JP] | Japan | 59-50067 |
| Mar. 15, 1984 | [JP] | Japan | 59-50068 |
| Oct. 1, 1984 | [JP] | Japan | 59-205898 |

[51] Int. Cl.[4] ..... F02B 75/04

[52] U.S. Cl. ..... 123/52 A; 123/54 B; 123/55 VF; 123/51 AA

[58] Field of Search ..... 123/52 M, 52 MV, 52 A, 123/54, 51 R, 51 A, 51 AA, 55 R, 55 VF

[56] References Cited

U.S. PATENT DOCUMENTS

| | | | |
|---|---|---|---|
| 497,239 | 5/1893 | Grant | 123/51 AA |
| 1,361,619 | 12/1920 | Roos | 123/54 R |
| 1,816,406 | 7/1931 | Spencer | 123/54 A |
| 2,387,843 | 10/1945 | Gray | 123/51 AA |
| 3,384,058 | 5/1968 | Kiekhaefer et al. | 123/52 A |
| 4,331,111 | 5/1982 | Bennett | 123/52 A |
| 4,470,379 | 9/1984 | Miyakoshi et al. | 123/52 A |

*Primary Examiner*—Craig R. Feinberg
*Attorney, Agent, or Firm*—Lyon & Lyon

[57] ABSTRACT

A multi-cylinder internal combustion engine comprising: first and second crankshafts disposed apart from and parallel with each other; first and second pistons operatively connected to the first and second crankshafts through connecting rods, respectively; and first and second cylinders for slidably accommodating therein the first and second pistons, respectively, both the crankshafts being interlocked with each other to rotate synchronously, the first and second cylinders being disposed adjacent to each other in the axial directions of the crankshafts. Vibrations due to the primary inertial force can be eliminated or alleviated without using a special balancer shaft. The size and weight of the engine are greatly reduced as compared with a conventional horizontally opposed type or V type engine.

7 Claims, 5 Drawing Figures

MULTI-CYLINDER INTERNAL COMBUSTION ENGINE

BACKGROUND OF THE INVENTION

1. Field of the Invention

The present invention relates to a multi-cylinder internal combustion engine which includes at least two cylinders each accommodating therein a piston, and valve actuating cam shafts disposed to extend over respective cylinder heads.

2. Description of the Prior Art

Heretofore, a multi-cylinder internal combustion engine has been formed to include a single common crankshaft which is interlocked through a timing device with cam shafts disposed to extend over respective cylinder heads.

In the mentioned multi-cylinder internal combustion engine, when two cylinders are arranged in a horizontally opposed form or V form in order to reduce vibrations, the cylinders must extend away from each other with the crankshaft therebetween. Such an arrangement impairs compactness of the engine. Further, a relatively long distance must exist between the crankshaft and the cam shaft, increasing the size of the timing mechanism connecting both the shafts. This requirement also impairs compactness of the engine.

Moreover, when coupling a transmission to a horizontally opposed type or V type engine, the transmission is arranged adjacent one end or one side of the crankshaft so that it is spaced from the cylinders.

Such an arrangement results in the engine and transmission assembly being large. With such engines, it is difficult to design an arrangement for small-sized vehicles such as motorcycles.

SUMMARY OF THE INVENTION

The present invention has been proposed in view of foregoing situation surrounding the prior art and has for a first object the provision of a multi-cylinder internal combustion engine which is more compact than the conventional horizontally opposed type or V type engine, which can offer a vibration reducing effect comparable to that obtained by such conventional engine, and which employs a timing device which can be made compact.

Another object of the present invention is to provide a multi-cylinder internal combustion engine which can eliminate or alleviate vibrations due to the primary inertial force without resorting to a special balancer shaft like the conventional horizontally opposed type or V type engine, and which, when coupled with a transmission, can provide a more compact size than the conventional engine coupled with a transmission.

To achieve the above objects, according to the present invention, there is proposed a multi-cylinder internal combustion engine comprising: first and second crankshafts disposed apart from and parallel with each other; first and second pistons operatively connected to the first and second crankshafts through connecting rods, respectively; and first and second cylinders for slidably accommodating therein the first and second pistons, respectively, wherein both the crankshafts are interlocked with each other to rotate synchronously, and wherein the first and second cylinders are arranged adjacent to each other in the axial direction of the crankshafts.

With such arrangement, vibrations due to the primary inertial force can be eliminated or alleviated without attaching balancer weights to the crankshaft or by providing only balancer weights, like the conventional horizontally opposed type or V type engine, and the entire size can be reduced in comparison with comparable conventional engines. As a result, it becomes possible to obtain a multi-cylinder internal combustion engine which is light in weight, compact in size and produces less vibrations.

According to the present invention, there is also proposed a multi-cylinder internal combustion engine in which an engine body is composed of a central block having first and second cylinders formed therein, and a pair of side blocks secured to both lateral sides of the central block, each of which side blocks has a crankcase integrally formed therewith for accommodating and supporting the crankshaft of one system in cooperation with the central block, and a cylinder head integrally formed therewith for defining a combustion chamber communicating with the cylinder of the other system. With this arrangement, though two cylinders are arranged with their heads directed in the opposite directions, the crankcase of one system is formed integrally with the cylinder head of the other system, whereby the number of components of the engine body becomes relatively small, thus providing a significant effect in further simplification of the engine structure.

In the above arrangements, if the first and second cylinders are arranged to cross in an X-like form, vibrations due to the primary inertial force can be eliminated or significantly alleviated like the conventional V type engine, just by properly selecting phase of the first and second pistons and by attaching balancer weights to the first and second crankshafts in appropriate positions. In this case, the resulting engine has a smaller lateral width than the V type engine.

According to the present invention, there is further proposed a multi-cylinder internal combustion engine wherein first and second cylinders are disposed on a plane or on one side of a plane connecting between the axes of the first and second crankshafts, and a transmission driven by both the crankshafts is disposed on the other side of the plane. With this arrangement, the transmission can be arranged adjacent both the crankshafts as well as both the cylinders, thus making it possible to reduce the entire size in combination with the compact engine as mentioned above.

According to the present invention, there is still further proposed a multi-cylinder internal combustion engine in which first and second cylinders are arranged adjacent to each other in the axial direction of the crankshafts with heads of both the cylinders staggered, first and second intake systems are connected to the heads of the first and second cylinders, respectively, in postures extending upwardly of respective cylinder heads, and a starting motor capable of cranking at least one of the first and second crankshafts is disposed between the first and second intake systems. With this arrangement, two intake systems and the starting motor are arranged on one side of both the cylinders in a concentrated manner, so that there is produced no dead space on the side of the cylinders and the entire engine may be made greatly compact in combination with its reduced lateral width as mentioned above. Moreover, since the starting motor of relatively large weight is located near the center between both the crankshafts, the engine will not lose its lateral weight balance in positions of both the crankshafts and it can be stably supported when loaded on a vehicle and the like.

The above effect can be achieved more positively by arranging the starting motor at substantially the top apex of an equilateral triangle with the base thereof formed by a straight line connecting the axes of the first and second crankshafts.

According to the present invention, there is still further proposed a multi-cylinder internal combustion engine wherein a synchronizing device adapted to synchronously interlock the first and second crankshafts is disposed between the first and second cylinders which are arranged adjacent to each other in the axial direction of both the crankshafts. With this arrangement, though the cylinder of one system is arranged near the end of the crankshaft of the other system, both the crankshafts can be synchronously interlocked together without suffering any interference from the adjacent cylinders.

According to the present invention, there is still further proposed a multi-cylinder internal combustion engine of the type in which the mentioned sychronizing device comprises first and second drive gears of the same diameter fixed to the first and second crankshafts, respectively, and a driven gear having a larger diameter than the drive gears and meshing therewith, the driven gear being fixed to a drive shaft disposed on one side of either of the cylinders and connected to a load member. With this arrangement, the synchronizing device can function as a speed reduction device and output of both the crankshafts can be transmitted to the drive shaft without suffering any interference from the cylinders, whereby there is no need of specially providing a separate speed reduction device adapted to drive the drive shaft, thus resulting in a more simplified and compact construction.

According to the present invention, there is still further proposed a multi-cylinder internal combustion engine in which, in addition to forming the synchronizing device to serve also as a speed reduction device, the driven gear of the synchronizing device is connected to the inner end of a hollow drive shaft passing one side of either of the cylinders, an input member of a clutch is connected to the outer end of the drive shaft, and an output member of the clutch is connected to a transmission input shaft disposed to extend through the hollow interior of the drive shaft. With this arrangement, the synchronizing device can also exhibit a power transmitting function and output of both the crankshafts can be transmitted to the clutch through the drive shaft without receiving any interference from the cylinders, whereby there is no need of specially providing a separate transmission device adapted to drive the drive shaft, thus resulting in a further simplified and compact construction. Further, the clutch locating on the outer side of the cylinders receives less influence of heat generated from the cylinders, and this is advantegeous in improving the durability thereof.

Moreover, since the drive shaft disposed to pass one side of either cylinder so as to drive the exterior clutch is formed to be hollow and a transmission input shaft connected to the output member of the clutch is arranged to extend through the hollow interior of the drive shaft, as previously mentioned, the concentric portions of both the drive shaft and the transmission input shaft can be disposed at relatively long lengths by utilizing a space obtained at one side of either cylinder, these concentric portions constituting a transmission shaft of length corresponding to two times the length of concentric region in cooperation with the clutch, thereby providing a torsional function to effectively absorb torque fluctuations.

In addition, by so arranging that first and second valve actuating cam shafts are disposed over heads of the first and second cylinders, respectively; that the first and second cylinders are arranged adjacent to each other such that the inter-axis distances between the crankshaft and the cam shaft belonging to the opposite systems, i.e., the inter-axis distance between the first crankshaft and the second cam shaft as well as the inter-axis distance between the second crankshaft and the first cam shaft, are shorter than the inter-axis distances between the crankshaft and the cam shaft belonging to the same system, i.e., the inter-axis distance between the first crankshaft and the first cam shaft as well as the inter-axis distance between the second crankshaft and the second cam shaft, respectively; and that the crankshaft and the cam shaft belonging to the opposite systems are interlocked with each other through a timing device, it is ensured that the timing device can be made considerably compact, contributing to a further reduction in the size, weight and cost, while permitting lag in timing of opening and closing operations of the valves to be made quite small.

Furthermore, in such a multi-cylinder internal combustion engine as having a synchronizing device which is disposed between the first and second cylinders to serve also as a speed reduction device, the later-described advantages can be obtained by arranging such that the first and second crank shafts are disposed to extend horizontally and longitudinally of the vehicle, one cylinder is positioned relatively near the front side of the vehicle, the drive shaft is extended to pass below one cylinder to project its front end forwardly of the one cylinder, the driven gear of the synchronizing device is connected to the rear end of the drive shaft, and the clutch is mounted to the front end of the drive shaft.

Namely, the synchronizing device can also exhibit a power transmitting function, and due to the crankshafts being both arranged to extend horizontally and longitudinally of the vehicle, the weight of respective components is concentrated on a position between both the crankshafts by virtue of the foregoing arrangement of the cylinders, whereby the center of gravity of the engine is displaced only a little to achieve a well-stabilized running posture of the vehicle even when it is inclined. Furthermore, since the drive shaft has its front end projected into the front side of the vehicle and the clutch is mounted to the projected front end, the clutch receives less influence of heat generated from the cylinders while being effectively cooled by travelling winds, as a result of which the durability is significantly improved.

According to the present invention, there is still further proposed a multi-cylinder internal combustion engine wherein first and second valve actuating cam shafts are disposed parallel to the first and second crankshafts both extending on a horizontal plane and are arranged over the first and second cylinders, a single common output shaft is interlocked with both the crankshafts, the crankshaft of one system is interlocked with the cam shaft of the other system through a timing device, respectively, and the axes of the first and second crankshafts are located within a triangle formed by connecting between three axes of the first cam shaft, the second cam shaft and the output shaft. With this arrangement, it becomes also possible to provide a more compact engine than the conventional horizontally opposed type or V type engine while ensuring a comparable vibration reducing effect, as well as to improve the accuracy in timing of opening and closing operations of the valves.

In addition, the arrangements as mentioned above make it possible in collaboration to reduce the total lateral width of the engine to substantially half of that of a conventional horizontally opposed type engine.

BRIEF DESCRIPTION OF THE DRAWINGS

FIGS. 1 to 5 illustrate one embodiment of the present invention in which:

FIG. 1 is a side view of a two-wheeled motorcycle loaded with a multi-cylinder internal combustion engine according to the present invention;

FIG. 2 is a sectional rear view of the engine;

FIG. 3 is a sectional view taken along the line III—III of FIG. 2;

FIG. 4 is a sectional view taken along the line IV—IV of FIG. 3; and

FIG. 5 is a longitudinal developed view of the engine.

DESCRIPTION OF THE PREFERRED EMBODIMENT

Hereinafter, one embodiment of the present invention will be described with reference to the accompaning drawings.

Figure 1:
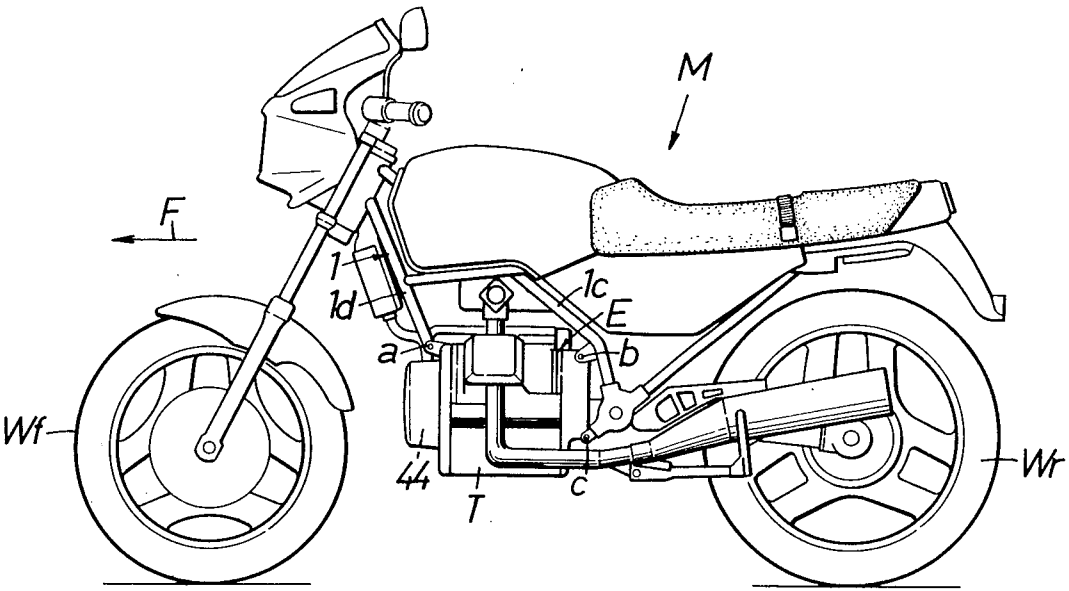

FIGS. 1 to 5 illustrate a preferred embodiment of the present invention. Referring first to FIG. 1, a motorcycle M includes a multi-cylinder internal combustion engine E of the present invention, which is mounted on a body frame 1 between front and rear wheel Wf, Wr. The engine E is screwed at one position a to the lower end part of a down tube 1*d* and at two upper and lower positions b, c to a center tube 1*c*; i.e., at three positions in total.

Structure of the engine E will be described by referring to FIGS. 2 to 5. The engine E has two crankshafts $2_1$, $2_2$ which are arranged to be parallel with and laterally spaced from a longitudinal axis of the motorcycle M through the same distance. In the illustrated embodiment, the crankshaft $2_1$ on the left side L of the vehicle and the crankshaft $2_2$ on the right side R thereof will be referred to as a first crankshaft and a second crankshaft, respectively.

First and second pistons $4_1$, $4_2$ are operatively connected to the first and second crankshafts $2_1$, $2_2$ through first and second connecting rods $3_1$, $3_2$, respectively. First and second cylinders $5_1$, $5_2$ for slidably accommodating therein the pistons $4_1$, $4_2$, respectively, are arranged adjacent to each other in the axial direction of the crankshafts $2_1$, $2_2$ such that the cylinders are inclined or laid in the direction approaching to each other. In practice, the cylinders $5_1$, $5_2$ are arranged side by side in a substantially horizontal direction as shown, or to cross each other to form an X figure as a whole. In the illustrated embodiment, the second cylinder $5_2$ is arranged near the front side F of the vehicle relative to the first cylinder $5_1$. Meanwhile, a transmission T is disposed under a plane connecting between the axes of the crankshafts $2_1$ and $2_2$.

A body 6 of the engine E is composed of a central block 6*c* and left-hand and right-hand blocks 6*l*, 6*r*, which are abutted with left and right ends of the central block through gaskets 7, 7 and secured thereto by a plurality of bolts 8, respectively. The central block 6*c* forms therein the first and second cylinders $5_1$, $5_2$. The right-hand block 6*r* is integrally formed with a first cylinder head $10_1$ defining a first combustion chamber $9_1$ together with the first piston $4_1$ therebetween and a second crankcase $11_2$ for accommodating the second crankshaft $2_2$ in cooperation with the central block 6*c*. The left-hand block 6*l* is integrally formed with a second cylinder head $10_2$ defining a second combustion chamber $9_2$ together with the second piston $4_2$ therebetween and a first crankcase $11_1$ for accommodating the first crankshaft $2_1$ in cooperation with the central block 6*c*. In this case, the left-hand and right-hand blocks 6*l*, 6*r* are formed to have the same configuration for interchangeability.

For supporting the first crankshaft $2_1$, two pairs of semicircular bearing walls $13_1$, $13_1$; $14_1$, $14_1$ for holding therebetween a pair of bearings $12_1$, $12_1$ mounted at both ends of the first crankshaft $2_1$ are formed in the opposed surfaces of the central block 6*c* and the first crankcase $11_1$, respectively, whereas for supporting the second crankshaft $2_2$, two pairs of semicircular bearing walls $13_2$, $13_2$; $14_2$, $14_2$ for holding therebetween a pair of bearings $12_2$, $12_2$ mounted on both ends of the second crankshaft $2_2$ are formed in the opposed surfaces of the central block 6*c* and the second crankcase $11_2$, respectively.

In the cylinder heads $10_1$, $10_2$ are formed intake ports $15_1$, $15_2$ and exhaust ports $16_1$, $16_2$ communicating with the corresponding combustion chambers $9_1$, $9_2$, respectively. In this embodiment, the intake ports $15_1$, $15_2$ have inlets opened upwardly and the exhaust ports $16_1$, $16_2$ have outlets opened downwardly, so that intake air and exhaust gas are caused to flow in the form of a crossing flow (see FIG. 2).

Carburetors $17_1$, $17_2$ are mounted to the inlets of the intake ports $15_1$, $15_2$, respectively. These intake ports $15_1$, $15_2$ and carburetors $17_1$, $17_2$ constitute two separate intake systems $18_1$, $18_2$ and, by utilizing a space 19 between the intake systems $18_1$, $18_2$, a starting motor 20 is disposed with its drive shaft 20*a* extending parallel to the crankshafts $2_1$, $2_2$. In particular, the starting motor 20 is located at the top apex of a substantially equilateral triangle having its base formed of a straight line connecting between the axes of both the crankshafts $2_1$, $2_2$, and the motor is placed on an installation surface 21, which is formed at the upper central part of the central block 6*c* to provide an elevated stand, and is then fixed thereto by means of bolts 22.

Intake and exhaust valves $23_1$, $23_2$; $24_1$, $24_2$ for opening and closing the intake and exhaust ports $15_1$, $15_2$; $16_1$, $16_2$, respectively, are mounted in the corresponding cylinder heads $10_1$, $10_2$ and are biassed in the valve-closing direction by means of valve springs $25_1$, $25_2$; $26_1$, $26_2$, respectively.

On the cylinder heads $10_1$, $10_2$ are interposed through packings 29, 29 heads covers $28_1$, $28_2$ for defining valve actuating chambers $27_1$, $27_2$ therebetween, and are secured thereto by a plurality of bolts (not shown).

In the valve actuating chambers $27_1$, $27_2$ there are installed valve actuating devices $30_1$, $30_2$ for causing the intake and exhaust valves $23_1$, $23_2$; $24_1$, $24_2$ to open, respectively.

More specifically, cam shafts $31_1$, $31_2$ arranged parallel to the crankshafts $2_1$, $2_2$ are held between the cylinder heads $10_1$, $10_2$ and the head covers $28_1$, $28_2$ through two pairs of bearings $32_1$, $32_1$; $32_2$, $32_2$. Intake rocker arms 33*i*, 33*i* are disposed between the intake cams 31*i*, 31*i* of the cam shafts $31_1$, $31_1$ and the intake valves $23_1$, $23_2$ so as to bridge therebetween, whereas exhaust rocker arms 33*e*, 33*e* are disposed between exhaust cams 31*e*, 31*e* and the exhaust valves $24_1$, $24_2$ so as to bridge therebetween. These rocker arms 33*i*, 33*e* are pivotably supported on rocker shafts 34*i*, 34*e* which in turn are supported on the corresponding head covers $28_1$, $28_2$. Herein, the cam shaft $31_1$ on the first cylinder head $10_1$ side will be referred to as a first cam shaft, and the cam shaft $31_2$ on the second cylinder head $10_2$ side will be referred to as second cam shaft.

In the engine body 6 there is formed a gearing chamber 35 extending from one head cover $28_1$ to the other head cover $28_2$ while passing between both the cylinders $5_1$and $5_2$. The crankshafts $2_1$, $2_2$ are interlocked with each other in the gearing chamber 35 through a synchronizing device 36 so as to be rotated synchronously. The synchronizing device 36 comprises first and second drive gears $37_1$, $37_2$ of the same diameter fixed to the crankshafts $2_1$, $2_2$, respectively, and a driven gear 38 having a larger diameter than those drive gears $37_1$, $37_2$ and meshing therewith.

Also in the gearing chamber 35, the second crankshaft $2_2$ is interlocked with the first cam shaft $31_1$ through a first timing device $39_1$, whereas the first crankshafts $2_1$ is interlocked with the second cam shaft $31_2$ through a second timing device $39_2$. The first timing device $39_1$ comprises the second drive gear $37_2$ and a timing gear $40_1$, which gear $40_1$ is secured to the first cam shaft $31_1$, meshes with the drive gear $37_2$ and has two times more the number of gear teeth than the drive gear $37_2$, whereas the second timing device $39_2$ comprises the first drive gear $37_1$ and a timing gear $40_2$, which gear $40_2$ is secured to the second cam shaft $31_2$, meshes with the drive gear $37_1$ and has two times more the number of gear teeth than the drive gear $37_1$. Accordingly, the first and second drive gears $37_1$, $37_2$ serve as common components for the synchronizing device 36 as well as the first and second timing devices $39_1$, $39_2$.

To eliminate backlash of the timing devices $39_1$, $39_2$, each of the timing gears $40_1$, $40_2$ is divided into two gears 40*a*, 40*b* slightly rotatable relative to each other, and an elestic member 41 is interposed between both the gears 40*a* and 40*b* to produce a resilient force for shifting the phase therebetween.

Further, in order to absorb torque fluctuations generated between the synchronizing device 36 and a later-described drive shaft 43, the driven gear 38 is divided into an outer wheel 38*a* on the teeth side and an inner wheel 38*b* on the boss side which wheels are rotatable relative to each other within a specified range, and a torque damper member 42 capable of deforming upon receipt of the rotation torque larger than a predetermined value is interposed between those wheels 38*a* and 38*b*.

Figure 5:
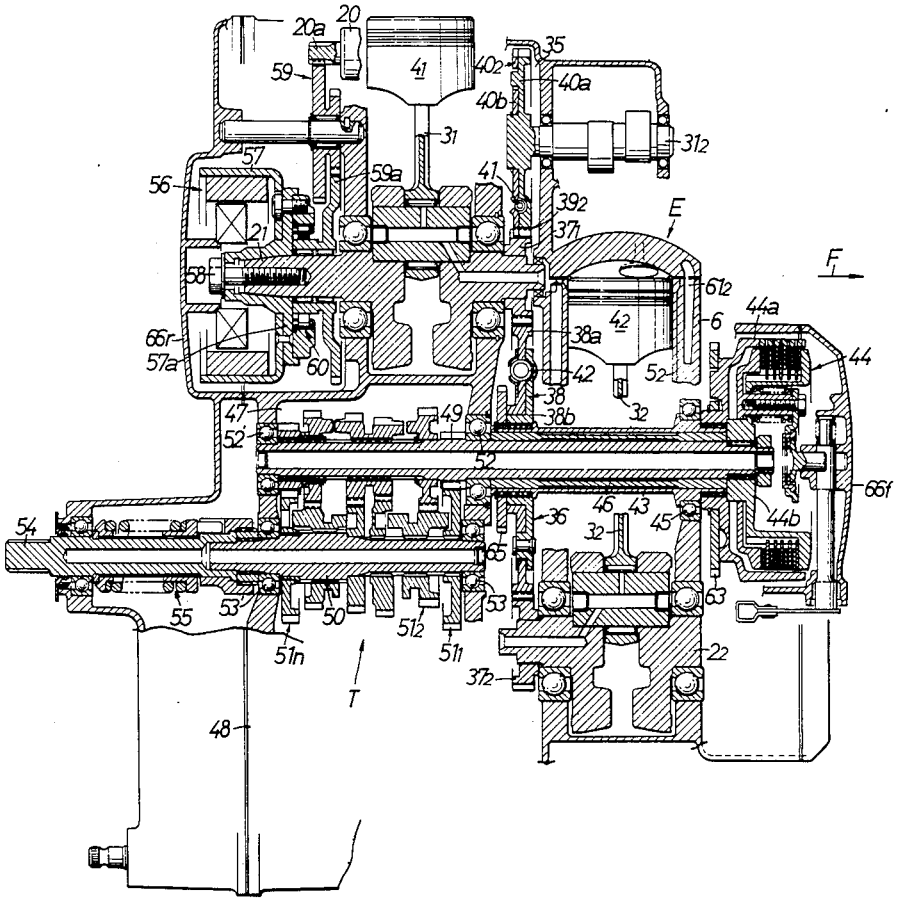

As shown in FIG. 5, the inner wheel 38*b* of the driven gear 38 is spline-coupled to the rear end of the hollow drive shaft 43 which extends from the transmission chamber 35 parallel to the crankshafts $2_1$, $2_2$ while passing through the front half of the central block 6*c*, and an input member of a multi-plate friction clutch 44, i.e., a clutch outer 44*a*, is spline-coupled to the front end of the drive shaft 43. In this way, the clutch 44 is located in the foremost part of the engine E in the direction toward the vehicle head. Accordingly, there are obtained advantages that the clutch 44 is favorably cooled by effectively receiving travelling winds, and that the space produced just behind the front wheel Wf can be utilized to check and repair the clutch 44 with ease.

The drive shaft 43 has its front end part supported on the central block 6*c* through a bearing 45 and its rear end part supported on a later-described transmission input shaft 49 through a bearing tube 46 fitted in the hollow portion of the drive shaft.

In this connection, the crankshafts $2_1$, $2_2$ are arranged to have their axes located within a triangle A (see FIG. 2) connecting three axes of both the cam shafts $31_1$, $31_2$ and the output shaft 43. More specifically, when the crankshafts $2_1$, $2_2$ are both arranged on the base a of the triangle A, i.e., a straight line connecting two axes of the cam shafts $31_1$, $31_2$, the cylinders $5_1$, $5_2$ come into a horizontal arrangement. On the other hand, when the first and second crankshafts $2_1$, $2_2$ are arranged on two oblique sides b, c of the triangle A, i.e., on a straight line b connecting two axes of the second cam shaft $31_2$ and the output shaft 43 and on a straight line c connecting two axes of the first cam shaft $31_1$ and the output shaft 43, respectively, or when the crankshafts $2_1$, $2_2$ are both arranged inside the triangle, the cylinders $5_1$, $5_2$ come into an X type arrangement.

Then, to the lower surface of the central block 6*c* is secured a transmission case 48 defining a speed change chamber 47 therebetween, in which there is installed a transmission T. More specifically, transmission input and output shafts 49, 50 are disposed in parallel to the crankshafts $2_1$, $2_2$, and multi-staged gear trains $51_1$, $51_2$. . . $51_n$ are fitted over both the shafts 49, 50 to provide different speed change ratios.

In the illustrated embodiment, the transmission input shaft 49 is held between the central block 6*c* and the transmission case 48 through a pair of front and rear bearings 52, 52', whereas the transmission output shaft 50 is supported on the transmission case 48 through a pair of front and rear bearings 53, 53'.

The transmission input shaft 49 is formed long to have its front end extending through the bearing tube 46 fitted in the hollow portion of the drive shaft 43 and projecting out of the front end face of the drive shaft 43, to which front end is spline-coupled an output member of the clutch 44, i.e., clutch inner 44*b*.

The rear end of the transmission output shaft 50 projecting out of the rear surface of the transmission case 48 is coupled through a torque damper mechanism 55 with final output shaft 54 for driving a propeller shaft (not shown) to drive the rear wheel of the motorcycle M.

As shown in FIG. 5, an AC power generator 56 is provided, of which rotor 57 has an end plate 57*a* taper-fitted over the rear end of the first crankshaft $2_l$ and fixed thereto by means of a bolt 58.

Between the end plate 57*a* and the central block 6*c* there is disposed a starting reduction gearing 59 for amplifying and transmitting the starting torque of the starting motor 20 to the first crankshaft $2_1$. An output gear 59*a* of the reduction gearing 59 is fitted over the first crankshaft $2_1$ rotatably relative to each other and coupled to the end plate 57*a* through a roller type overrunning clutch 60.

Figure 3:
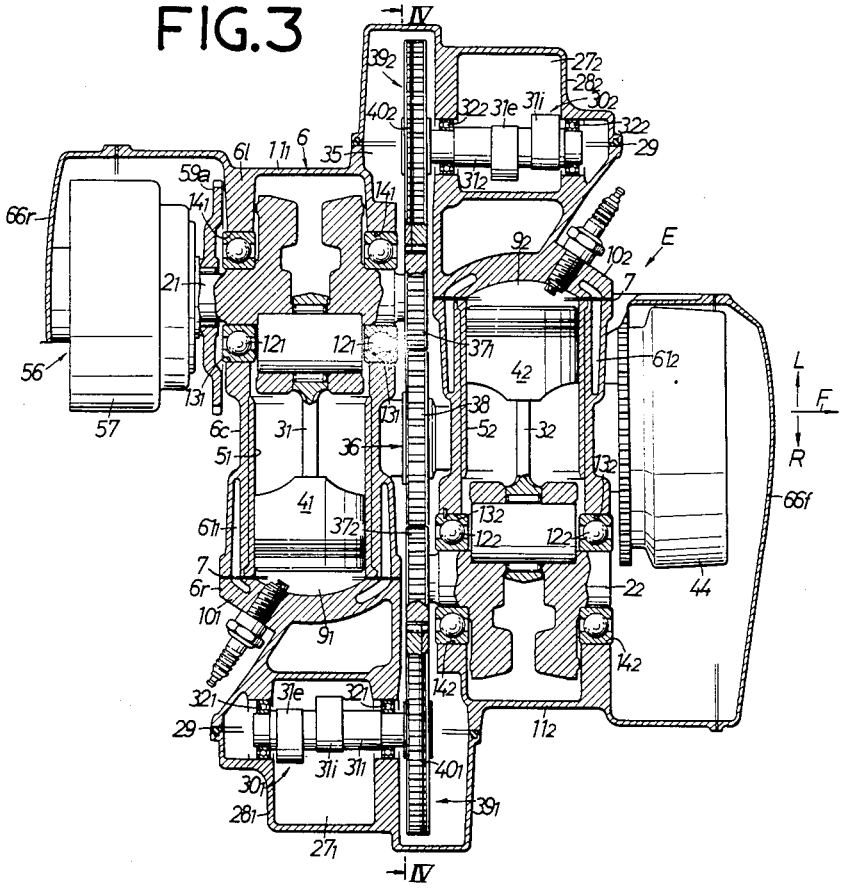
Figure 4:
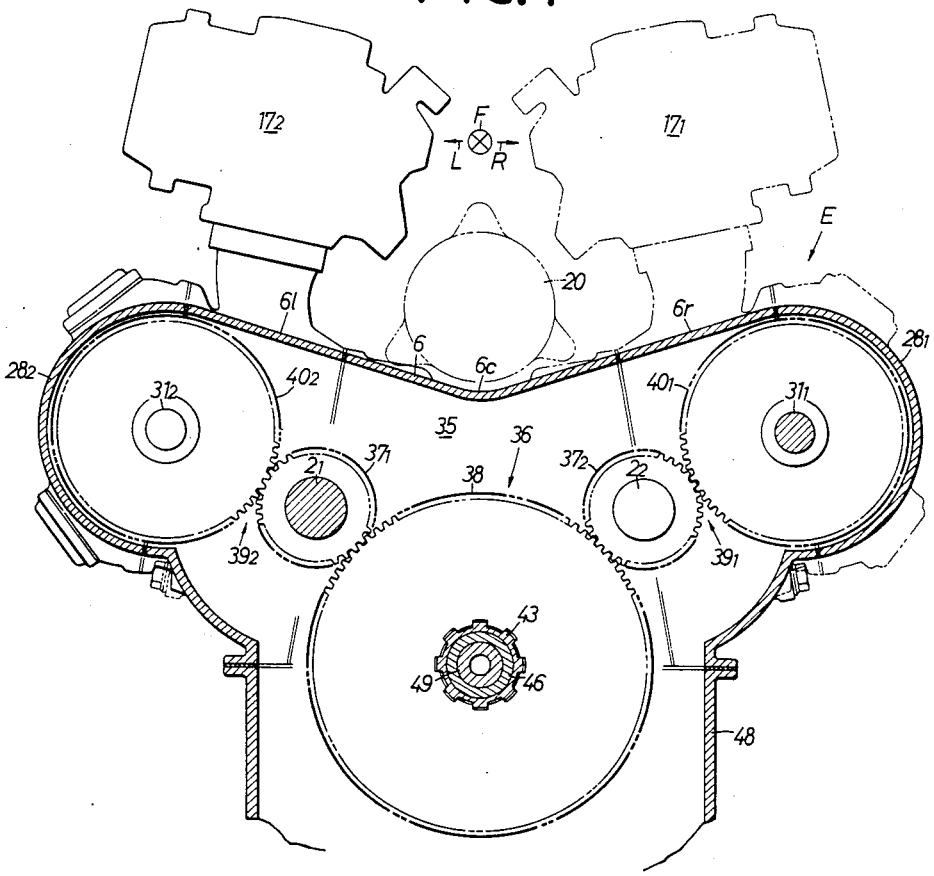

In the central block 6*c* and the cylinder heads $10_1$, $10_2$, as shown in FIG. 3, there are formed water jackets $61_1$, $61_2$ to surround the cylinders $5_1$, $5_2$ and the combustion chambers $9_1$, $9_2$, respectively, and a water pump drive gear 63 for driving a water pump (not shown) to supply cooling water to those water jackets $61_1$, $61_2$ is secured to the clutch outer 44*a*, as shown in FIG. 5.

Figure 2:
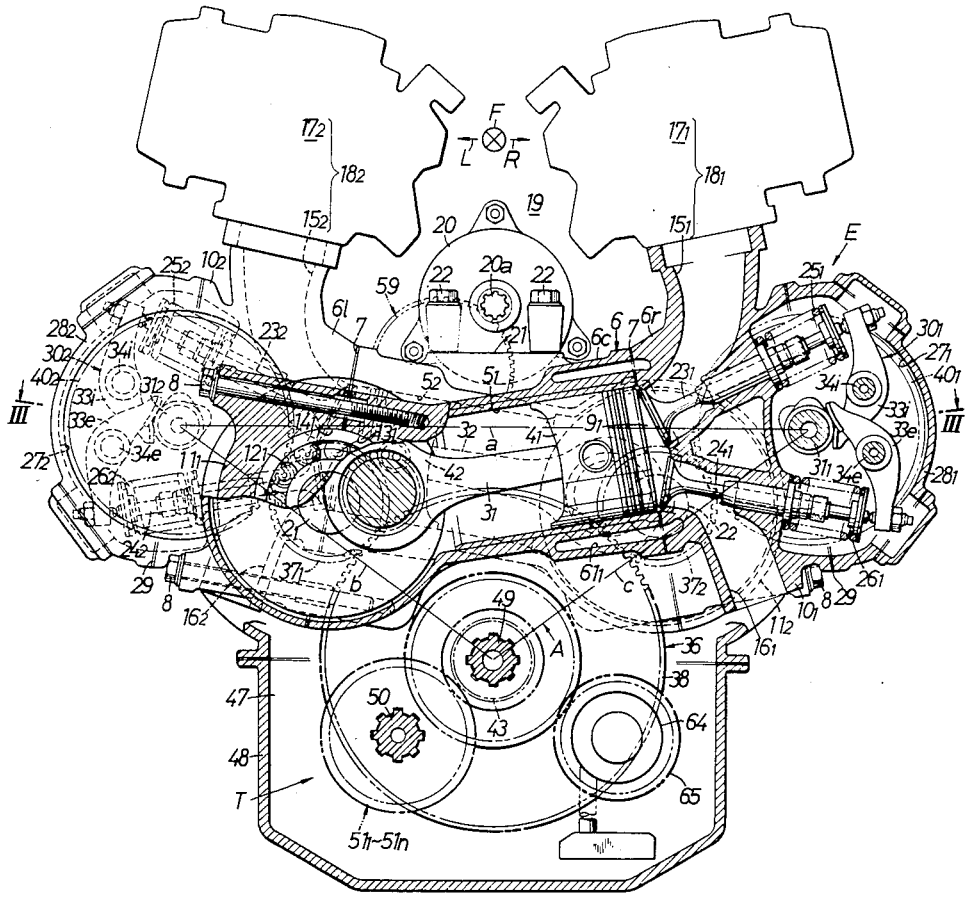

An oil pump 64 for pumping lubricating oil stored in the transmission case 48 to be supplied to respective motional parts of the engine E is installed within the transmission case 48 as shown in FIG. 2, and an oil pump drive gear 65 for driving the oil pump 64 is located adjacent the driven gear 38 and secured to the rear end of the drive shaft 43, as shown in FIG. 5.

Incidentally, in FIG. 5 designated at 66*f* is a front cover secured to the front surface of the central block 6*c* for covering the clutch 44, and at 66*r* is a rear cover secured to the rear surface of the central block 6*c* for covering the starting reduction gearing 59, the power generator 56 and the torque damper mechanism 55.

In the illustrated embodiment, similarly to conventional horizontally opposed type engines, the first and second pistons $4_1$, $4_2$ are moved in the opposite directions, and the first and second crankshafts $2_1$, $2_2$ are coupled with each other through the synchronizing device 36 so that they are synchronously rotated in the same direction. Accordingly, such arrangement that the crankshafts $2_1$, $2_2$ are both arranged on the base a of the triangle A, and the cylinders $5_1$, $5_2$ are both arranged to be horizontal or substantially horizontal, causes by itself all or almost of not only the primary inertial force but also the secondary inertial force in the first and second piston $4_1$, $4_2$ systems to be well balanced, thereby eliminating or significantly alleviating vibrations due to those inertial forces, like the conventional horizontally opposed type engines. In this case, it becomes further possible to reduce the total lateral width of the engine E to substantially half of that of the conventional horizontally opposed type engine.

On the other hand, in case of the structure where the first and second crankshafts $2_1$, $2_2$ are arranged on two oblique sides b, c of the triangle A, respectively, or they are both arranged inside the triangle A so as to bring the first and second cylinders $5_1$, $5_2$into the X type array, it becomes possible to eliminate or significantly alleviate vibrations due to the primary inertial force, like conventional V type engines, just by properly selecting phases of the first and second pistons $4_1$, $4_2$and attaching balancer weights to the first and second crankshafts $2_1$, $2_2$in appropriate positions. The total width of the engine in this case is reduced as compared with the V type engine.

In particular, when the first and second crankshafts $2_1$, $2_2$are arranged on two oblique sides b, c of the triangle A, respectively, the distance between the adjacent axes of the second cam shaft $31_2$, the first crankshaft $2_1$and the output shaft 43 as well as between the axes of the first cam shaft $31_1$, the second crankshaft $2_2$and the output shaft 43 can be minimized permitting the timing devices $39_1$, $39_2$and the synchronizing device 36 to be all made compact.

Stated differently, the inter-axis distances between the first crankshaft $2_1$and the second cam shaft $31_2$as well as between the second crankshaft $2_2$and the first cam shaft $31_1$become each shorter than the inter-axis distance between the crankshaft and the cam shaft belonging to the same system, because of adjacent arrangement of the cylinders $5_1$, $5_2$in the axial direction of the crankshafts. Thus, the timing device connecting each pair of the above shafts can be constituted to have a smaller size correspondingly.

Operation of this embodiment will be described below.

Now, when the starting motor 20 is actuated to put in service the engine E, the starting torque of the drive shaft 20*a* of the motor 20 is amplified by the starting reduction gearing 58 to be transmitted to the first crankshaft $2_1$through the overrunning clutch 60 and the end plate 57*a* of the rotor 57 and also to the second crankshaft $2_2$through the synchronizing device 36, thereby cranking both the crankshafts $2_1$and $2_2$simultaneously so that the engine E can be started up.

After start-up of the engine E, when the first crankshaft $2_1$is driven to rotate faster than the output gear 59*a* of the starting reduction gearing 59, the overrunning clutch 60 is brought into a disconnected state thereby to prevent the torque from being transmitted reversely from the first crankshaft $2_1$to the starting motor 20.

As previously noted, the starting motor 20 is arranged to locate at the top apex of a substantially equilateral triangle having a base thereof formed of a straight line connecting the axes of both the crankshafts $2_1$, $2_2$so that the the starting motor 20 of relatively large weight assumes a position just above the center of gravity of the engine E and the lateral weight balance of the engine E is ensured when loaded on the vehicle.

During operation of the engine E, the first and second crankshafts $2_1$, $2_2$are rotated synchronously to drive the driven gear 38 through the drive gears $37_1$, $37_2$with a certain reduction ratio, respectively. The rotation torque of the driven gear 38 is transmitted through the drive shaft 43, the clutch 44 and the transmission input shaft 49 in sequence to reach the transmission output shaft 50 and the final output shaft 54 through one gear train selected out of multi-staged gear trains $51_1$–$51$n. The output torque is further transmitted through a not-shown propeller shaft to the rear wheel Wr of the motorcycle M to drive the same. Relatively large torque fluctuations produced during such transmission are effectively absorbed with the damping action of the torque damper mechanism 55 as well as the torsional actions of the drive shaft 43 and the transmission input shaft 49.

In particular, the drive shaft 43 and the transmission input shaft 49 are both formed long to penetrate through the front half of the central block 6*c* and fitted to each other with their front ends coupled via the clutch 44, whereby in practice-the transmitting shaft has a length corresponding to two times the section of the central block 6*c* through which both the shafts penetrate, thus providing an effective torsional action.

Meanwhile, though the first and second cylinders $5_1$, $5_2$are each disposed near the crankshaft of its opposite system, i.e., the second and first crankshafts $2_2$, $2_1$, the synchronizing device 36 can interlock both the crankshafts $2_1$, $2_2$together in synchronous relation without suffering any interference from those cylinders $5_1$, $5_2$. Furthermore, since the large diameter driven gear 38 of the synchronizing device 36 is secured to the drive shaft 43 disposed under the first and second cylinders $5_1$, $5_2$, outputs of the crankshafts $2_1$, $2_2$can be taken out to the exterior without encountering any obstruction from the cylinders $5_1$, $5_2$and, on this occasion, the synchronizing device 36 functions also as a speed reduction device.

Since the transmission T composed of the transmission input and output shafts 49, 50 and the gear trains $51_1$–$51_n$is disposed right under the central block 6*c*, the lateral weight balance of the engine E when loaded on the vehicle will not be lost even with the transmission T having a large weight. Also, the transmission T has no part laterally extending out of the engine E, so that the lateral banking operation of the motorcycle M will not be restricted.

Furthermore, the first and second crankshafts $2_1$, $2_2$rotate the second and first cam shafts $31_2$, $31_1$of their opposite systems through the second and first timing devices $39_2$, $39_1$, respectively, thereby operating the valve actuating devices $30_1$, $30_2$to open and close the intake and exhaust valves $23_1$, $24_1$; $23_2$, $24_2$.

In this connection, the inter-axis distances between the first crankshaft $2_1$and the second cam shaft $31_2$as well as between the second crankshaft $2_2$and the first cam shaft $31_1$interlocked with each other through the timing devices $39_1$, $39_2$, respectively, are each shorter than the inter-axis distance between the crankshaft and the cam shaft belonging to the same system because of the above-mentioned arrangement of the cylinders $5_1$, $5_2$, whereby each of the timing devices $39_1$, $39_2$can be constituted to have a smaller size and errors in timing of opening and closing operations of the valves can be made smaller correspondingly.

It is to be noted that, although in the illustrated embodiment the synchronizing device 36 and the timing devices $39_1$, $39_2$were constituted in the form of gears, they may be in the form of chains or belts. In some cases, the synchronizing device 36 may be arranged to rotate the crankshafts $2_1$, $2_2$in the opposite directions from each other.

What is claimed is:

1. A multi-cylinder internal combustion engine comprising: first and second crankshafts disposed apart from and parallel with each other; first and second pistons operatively connected to said first and second crankshafts through connecting rods, respectively; first and second cylinders for slidably accommodating therein said first and second pistons, respectively; first and second cylinder heads positioned on one end of said first and second cylinders, respectively, each said cylinder head having overhead valves; first and second camshafts driving said overhead valves of each of said first and second cylinder heads, respectively; first and second crankcases within which said first and second crankshafts are rotably mounted, respectively; wherein both said crankshafts are interlocked with each other to rotate synchronously, and wherein said first and second cylinders are arranged adjacent to each other in an axial direction of said crankshafts, and wherein said first and second crankcases are displaced axially of said second and first camshafts, respectively; and said first and second camshafts being located overhead said first and second cylinder heads, respectively.

2. A multi-cylinder internal combustion engine comprising: first and second crankshafts disposed apart from and parallel with each other; first and second pistons operatively connected to said first and second crankshafts through connecting rods, respectively; first and second cylinders for slidably accommodating therein said first and second pistons, respectively first and second cylinder heads positioned on one end of said first and second cylinders, respectively, each said cylinder head having overhead valves; first and second camshafts driving said overhead valves of each of said first and second cylinder heads, respectively; first and second crankcases within which said first and second crankshafts are rotatably mounted, respectively; wherein both said crankshafts are interlocked with each other to rotate synchronously, said first and second cylinders are arranged adjacent to each other in an axial direction of said crankshafts, and wherein said engine has a body composed of a central block forming therein said first and second cylinders, and a pair of side blocks secured to both lateral sides of said central block, each of said side blocks being integrally formed with one of said crankcases for supporting and accommodating therein in operation with said central block one of said crankshafts which belongs to one system, and one of said cylinder heads defining therein a combustion chamber communicating with said cylinder head of the other system, said first and second crankcases being displaced axially from said second and first camshafts in each of said side blocks respectively; and said first and second camshaft being located overhead said first and second cylinder heads, respectively.

3. A multi-cylinder internal combustion engine according to claim 1 or 2, wherein said first and second cylinders are arranged to be substantially horizontal.

4. A multi-cylinder internal combustion engine according to claim 1 or 2, wherein said first and second cylinders are arranged to cross each other in an X-like form.

5. A multi-cylinder internal combustion engine according to claim 1 or 2, wherein a synchronizing device adapted to synchronously interlock said first and second crankshafts is disposed between said first and second cylinders.

6. A multi-cylinder internal combustion engine according to claim 5, wherein said synchronizing device comprises first and second drive gears of the same diameter fixed to said first and second crankshafts, respectively, and a driven gear having a larger diameter than both said drive gears and meshing therewith, said driven gear being fixed to a drive shaft disposed on one side of either of said cylinders and connected to a loading member.

7. A multi-cylinder internal combustion engine according to Claim 1 or 2 wherein said camshafts are located at opposite outermost positions in a lateral direction of the engine body normal to the axial direction of the crankshafts, said drive shaft is disposed at a substantially laterally central position, and said crankshafts are respectively located between the drive shaft and the camshafts.

* * * * *